US008811126B2

(12) United States Patent
Chiang et al.

(10) Patent No.: US 8,811,126 B2
(45) Date of Patent: Aug. 19, 2014

(54) INDIVIDUAL REMINDING DEVICE

(75) Inventors: Rayleigh Ping-Ying Chiang, Taipei (TW); Shih-Chung Kang, Taipei (TW); Chia-Hsuan Chiang, Taipei (TW); Zai-Ting Yeh, Sinjhuang (TW)

(73) Assignee: National Taiwan University (TW)

( * ) Notice: Subject to any disclaimer, the term of this patent is extended or adjusted under 35 U.S.C. 154(b) by 416 days.

(21) Appl. No.: 12/908,170

(22) Filed: Oct. 20, 2010

(65) Prior Publication Data

US 2011/0096637 A1 Apr. 28, 2011

(30) Foreign Application Priority Data

Oct. 23, 2009 (TW) ..... 98136063 A

(51) Int. Cl.

| | |
|---|---|
| ***G04C 21/30*** | (2006.01) |
| ***G04G 13/02*** | (2006.01) |
| ***G04G 11/00*** | (2006.01) |
| ***G04C 19/02*** | (2006.01) |
| ***G04C 21/16*** | (2006.01) |

(52) U.S. Cl.

CPC ..... *G04G 13/026* (2013.01); *G04G 11/00* (2013.01); *G04C 19/02* (2013.01); *G04C 21/16* (2013.01)

USPC ..... 368/246; 368/256

(58) Field of Classification Search

CPC ..... G04C 19/02; G04C 21/16; G04G 11/00; G04G 13/026

USPC ..... 368/72, 109, 256

See application file for complete search history.

(56) References Cited

U.S. PATENT DOCUMENTS

| | | | | |
|---|---|---|---|---|
| 3,727,397 | A * | 4/1973 | Ethier | 368/316 |
| 5,365,494 | A * | 11/1994 | Lynch | 368/10 |
| 7,280,439 | B1 * | 10/2007 | Shaddox | 368/73 |
| 2006/0133215 | A1 * | 6/2006 | Gordon et al. | 368/79 |

* cited by examiner

*Primary Examiner* — Amy Cohen Johnson
*Assistant Examiner* — Jason Collins
(74) *Attorney, Agent, or Firm* — Allen, Dyer, Doppelt, Milbrath & Gilchrist, P.A.

(57) ABSTRACT

The present model relates to an individual reminding device, comprising: an electrical timer providing a current time and at least one predetermined time; at least a directional reminding unit electrically connected with the electrical time providing a prompt toward a direction at the at least one predetermined time; and a display demonstrating the current time and the at least one predetermined time.

7 Claims, 2 Drawing Sheets

INDIVIDUAL REMINDING DEVICE

FIELD OF THE INVENTION

The present invention relates to an electrical timer, and more particularly to an electrical timer with scheduled reminding functions.

BACKGROUND OF THE INVENTION

For nowadays, it is a global village era, and every one in this society has totally different lifestyle. For example, among the roommates living in the same room in the college, someone might burn midnight oil for preparing examinations, however, some others might need a good sleep since just finishing examinations. Someone may need to attend the first class in the early morning, and have to get up at about 7 am, but other roommates do not have any courses in the morning. Or in a family, the husband and wife sleeping in the same room may go to different work by different time, and thus have totally different work and rest schedule respectively.

Under this situation, because of the thoroughly different lifestyles among people, for people living or sleeping in the same room, a certain level of interference among each other would be inevitably resulted from the different getting up time for every individual one. When the alarm clock set up by others makes a sound, one's sleep would be interfered or interrupted, and vice versa. Such interference due to many people living or sleeping in the same room would make the quality of one's sleeping getting worse.

For conventional alarm clocks, each alarm clock could be set to emit a prompt at only one specific awaking time. Even if it is allowed to set a plurality of awaking time or use a plurality of alarm clock, in the occasions that many people live or sleep in the same room and need to be waken up by different time, these people's sleeping would be interfered by the prompt irrelevant to them, and the sleeping quality would be influenced It is therefore attempted by the applicant to deal with the above situation encountered in the prior art.

SUMMARY OF THE INVENTION

In view of the prior art, in the occasions that many people live or sleep in the same room and need to be waken up, everyone's sleeping would be interfered by the reminding sound of the alarm clock irrelevant to them. Thus the present invention provides an individual reminding device which could wake each one up separately without interfering the others. A method of using a directional light and a directional sound is mainly applied. A sleeper at a determined direction would be woken up when a certain predetermined time arrives. However, the people living or sleeping with this person in the same room would not be interfered and the stable sleeping could be kept because the directional light and the directional sound are applied.

In accordance with the first aspect of the present invention, a reminding device is provided. The reminding device includes: a timer providing a set of predetermined times; at least one light source electrically connected to the timer and emitting a light toward a first direction; and at least one acoustic source electrically connected to the timer and producing a sound toward at least a second direction.

Preferably, the reminding device further includes a base configuring thereon the timer.

Preferably, one of the at least one light source and the at least one acoustic source is mechanically connected to the base through a prop stand.

Preferably, the prop stand is one of an adjustable prop arm and a flexible prop arm.

Preferably, the timer is an electrical timer.

Preferably, the at least one light source is one selected from a group consisting of a focus light source, an LED and a combination thereof.

Preferably, the light is a flash light.

Preferably, the sound is a directional sound.

Preferably, the first direction and the second direction are the same direction.

Preferably, the set of predetermined times include at least one predetermined time point.

In accordance with the second aspect of the present invention, a reminding device is provided. The reminding device includes: a timer providing a current time and at least one predetermined time; at least one directional reminding unit electrically connected to the timer and generating a prompt toward a specific direction at the at least one predetermined time; and a display device showing one of a current time and the at least one predetermined time.

Preferably, the at least one directional reminding unit includes one selected from a group consisting of at least one light source, at least one acoustic source and a combination thereof.

Preferably, the light source emits a light toward the direction at the at least one predetermined time.

Preferably, the acoustic source produces a sound toward the specific direction at the at least one predetermined time.

Preferably, the prompt is one selected from a group consisting of a light, a sound and a combination thereof.

Preferably, the display device is an LED display.

In accordance with the third aspect of the present invention, a reminding device is provided. The reminding device includes: a timer providing at least one predetermined time; and at least one reminding unit connected to the timer and generating a directional prompt toward a specific direction when the at least one predetermined time arrives.

Preferably, the at least one reminding unit is electrically connected to the timer.

BRIEF DESCRIPTION OF THE DRAWINGS

The foregoing and other features and advantages of the present invention will be more clearly understood through the following descriptions with reference to the drawings, wherein.

DETAIL DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1:
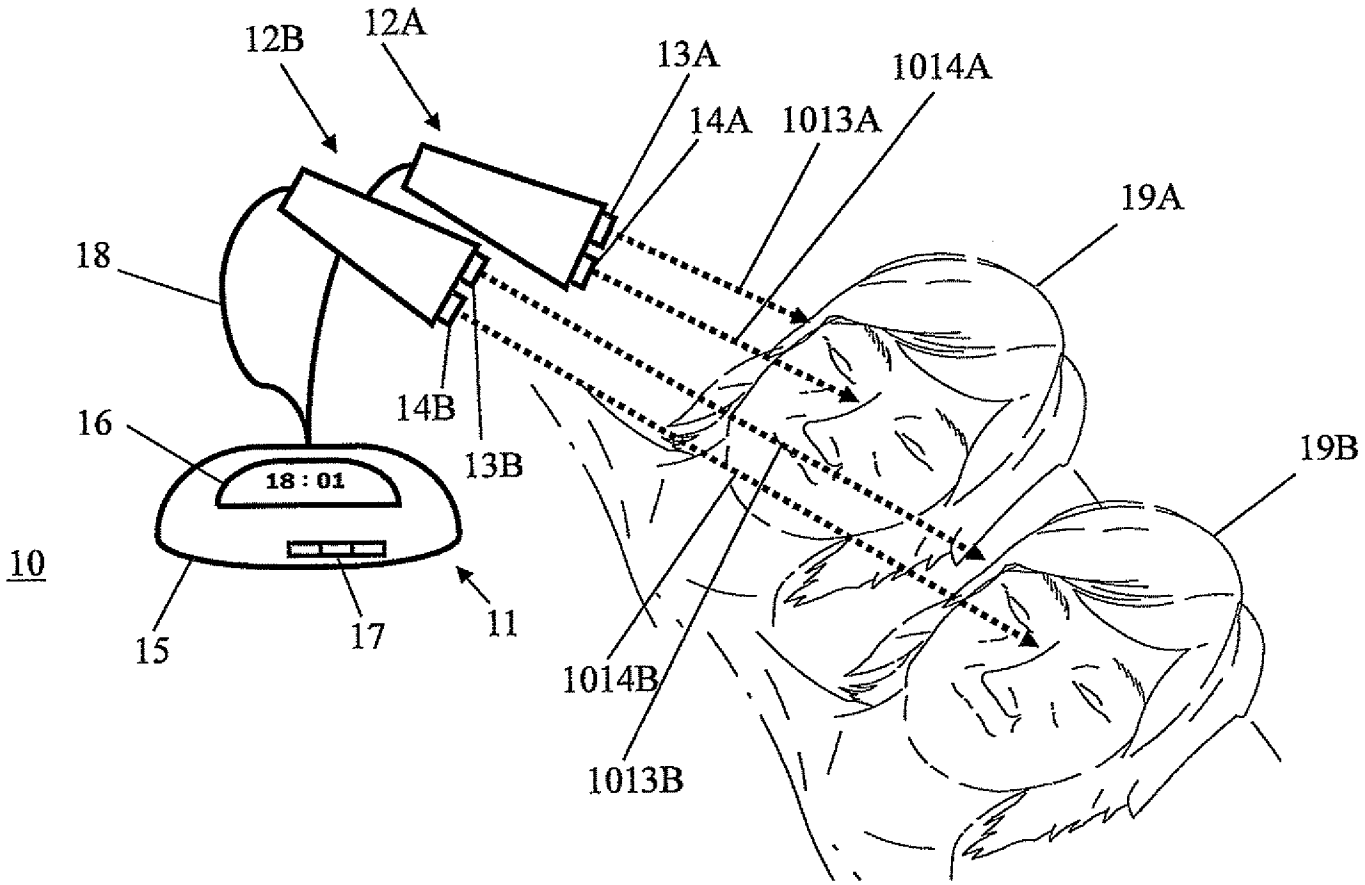
FIG. 1 is a diagram illustrating the first embodiment of the individual reminding device according to the present application.

Please refer to FIG. 1, which is a diagram illustrating the first embodiment of the individual reminding device according to the present application. An individual reminding device 10 in FIG. 1 is mainly composed of a timer 11, preferably an electrical timer, and at least one directional reminding unit 12. The timer 11 is an electrical instrument that could measure a current time and provide a notice signal when a predetermined time arrives. The timer 11 has a display device 16 and a controlling panel 17 configured on a base 15. The measured current time is displayed by the timer 11 via the display device 16. The timer 11 could be set up for at least one predetermined time by a sleeper via the controlling panel 17, and the display device 16 is displayed by utilizing LED.

The directional reminding unit 12 is mechanically connected to the base 15 through a prop stand 18. The prop stand 18 could be an adjustable prop arm or a flexible prop arm. The directional reminding unit 12 further includes an acoustic source 13 and a light source 14, wherein the acoustic source 13 and the light source 14 are separately electrically connected to the timer 11, and could receive the notice signal provided by the timer 11 when the predetermined time arrives. After the notice signal is received, the acoustic source 13 and the light source 14 could provide a directional sound 1013 and a directional light 1014 toward a specific direction. The light source 14 is preferably a focus light source or an LED light, and the directional light 1014 could be a flash light.

Please keep referring to FIG. 1, the individual reminding device 10 in FIG. 1 could be further divided into two sets, wherein the first set includes a first directional reminding unit 12A and the related for reminding the sleeper 19A mainly, and the second set includes a second directional reminding unit 12B and the related for reminding the sleeper 19B mainly. Two sets of the predetermined time predetermined by the sleepers are provided separately for the first directional reminding unit 12A and the second directional reminding unit 12B by the timer 11. Namely, an acoustic source 13A and a light source 14A in the first directional reminding unit 12A could receive a first set of notice signal provided by the timer 11 when the first set of the predetermined time arrives, and a directional sound 1013A and a directional light 1014A are provided toward a specific direction separately. An acoustic source 13B and a light source 14B in the first directional reminding unit 12B could receive a second set of notice signal provided by the timer 11 when the second set of the predetermined time arrives, and a directional sound 1013B and a directional light 1014B are provided toward a specific direction separately.

It is worthy to note that at least one predetermined time point is included in each set of the predetermined time. For example, two predetermined time points could be included, wherein a first predetermined time point is the time for getting up, and a second predetermined time point is 30 minutes before the time for getting up. When the second predetermined time arrives, the timer 11 would begin to emit a notice signal to the directional reminding unit 12.

As shown in FIG. 1, it is aimed at the situation that a plurality people live or sleep in the same room and need to be separately woken up scheduledly. For example, the sleeper 19A may want to get up before 7:30 am next morning, however, the sleeper 19B may want to get up around 9:00 am next morning. Then, the sleeper 19A could set the first predetermined time point of the first set of the predetermined time of the acoustic source 13A and the light source 14A in the first directional reminding unit 12A as 730 am next morning via the controlling panel 17 on the timer 11, and set the second predetermined time point as 7:30 am next morning. The sleeper 19B could set the first predetermined time point of the second set of the predetermined time of the acoustic source 13B and the light source 14B in the second directional reminding unit 12B as 9:00 am next morning, and set the second predetermined time point as 8:45 am next morning.

At 7:00 am next morning, the acoustic source 13A and the light source 14A begin to emit prompts, the directional sound 1013A and the directional light 1014A respectively, toward the sleeper 19A. It is not 7:30 am yet, and thus the prompt strength of the sound and the flash is still weak. Next, between 7:00 am and 7:30 am, the prompt strength would get stronger step by step till the sleeper 19A is woken up. At 8:45 am next morning, the acoustic source 13B and the light source 1413 begin to emit prompts, the directional sound 1013B and the directional light 1014A respectively, toward the sleeper 1913. The sleeper 1913 could set the prompt strength by himself as being fixed or getting stronger step by step till the sleeper 19B is woken up.

Under this situation, the directional sound 1013A and the directional light 1014A only wake the sleeper 19A up, but not interfere the sleeper 19B nearby. Thus, even if the sleeper 19A is woken up at 7:30 am next morning, the sleeping of the sleeper 19B is not influenced at all and keeps his sleeping without getting interfered.

Figure 2:
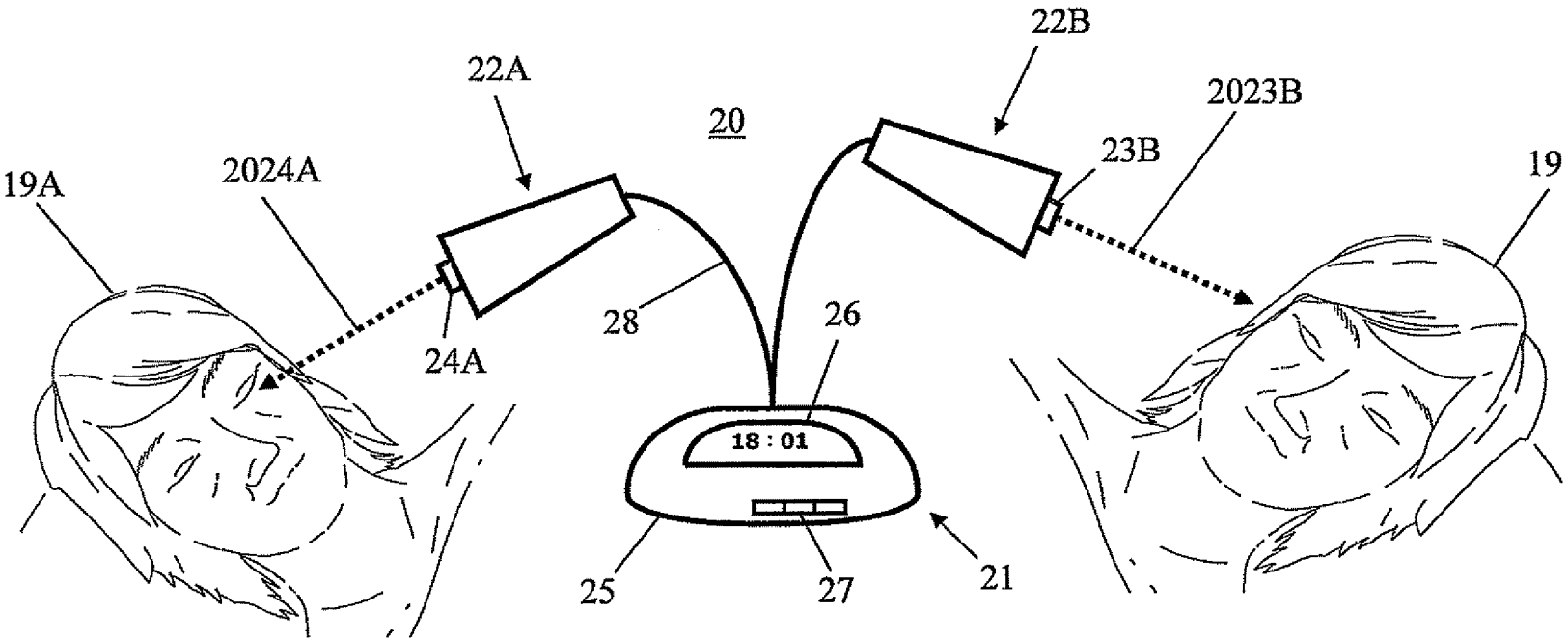
FIG. 2 is a diagram illustrating the second embodiment of the individual reminding device according to the present application.

Please refer to FIG. 2, which is a diagram illustrating the second embodiment of the individual reminding device according to the present application. When the invention is implemented, an acoustic source 23 and a light source 24 could be selectively installed in a directional reminding unit 22. As shown in FIG. 2, only a light source 24A and an acoustic source 23B are respectively installed in a first directional reminding unit 22A and a second directional reminding unit 22B of an individual reminding device 20. When the first set of the predetermined time and the second set of the predetermined time arrive, the light source 24A and the acoustic source 23B respectively emit a directional light 2024A and a directional sound 2023E toward a sleeper 29A and a sleeper 29B to wake the sleeper 29A and the sleeper 2913 separately.

In conclusion, in the individual reminding device of the present invention, a method of using a directional light and a directional sound is mainly applied to wake up a sleeper at a specific direction at a certain predetermined time point. Because the directional light and the directional sound are applied, the surrounding other people would not be interfered and could keep their stable sleeping.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A reminding device, comprising:

a timer providing a set of predetermined times;

a first adjustable reminding unit having a first directable light source and a first directable acoustic source, and electrically connected to the timer, wherein the first directable light source emits a first directable light toward a first direction at a first predetermined time and the first directable acoustic source produces a first directable sound toward the first direction at the first predetermined time;

a second adjustable reminding unit having a second directable light source and a second directable acoustic source, and electrically connected to the timer, wherein the second directable light source emits a second directable light toward a second direction, at a second predetermined time, different from the first predetermined time, and the second directable acoustic source produces a second directable sound toward the second direction at the second predetermined time; and a base, on which the timer, the first reminding unit, and the second reminding unit are attached, wherein the first reminding unit and the second reminding unit are mounted on separate flexible prop arms to facilitate custom orientation in two different directions.

2. The reminding device as in claim 1, wherein the timer is an electrical timer.

3. The reminding device as in claim 1, wherein one of the first directable light source and the second directable light source is one selected from a group consisting of a focus light source, an LED and a combination thereof.

4. The reminding device as in claim 1, wherein one of the first directable light and second directable light is a flash light.

5. The reminding device as in claim 1, wherein the first direction and the second direction refer to a same direction or different directions.

6. The reminding device as in claim 1, wherein the set of predetermined times comprise at least one predetermined time point.

7. The reminding device as in claim 1, further comprising a display device showing one of the current time, the first predetermined time and the second predetermined.

* * * * *